US011066735B2

(12) United States Patent
Ren et al.

(10) Patent No.: US 11,066,735 B2
(45) Date of Patent: Jul. 20, 2021

(54) METAL CARBURIZATION PROCESS TO PRODUCE A UNIFORM, CONCENTRATED SOLID SOLUTION OF INTERSTITIAL CARBON WORKPIECE AND ARTICLES MADE FROM SAME

(71) Applicant: CASE WESTERN RESERVE UNIVERSITY, Cleveland, OH (US)

(72) Inventors: Zhe Ren, Cleveland, OH (US); Frank Ernst, Cleveland, OH (US)

(73) Assignee: CASE WESTERN RESERVE UNIVERSITY, Cleveland, OH (US)

( * ) Notice: Subject to any disclaimer, the term of this patent is extended or adjusted under 35 U.S.C. 154(b) by 0 days.

(21) Appl. No.: 16/654,367

(22) Filed: Oct. 16, 2019

(65) Prior Publication Data

US 2020/0087773 A1 Mar. 19, 2020

Related U.S. Application Data

(63) Continuation-in-part of application No. 15/308,223, filed as application No. PCT/US2015/029372 on May 6, 2015, now Pat. No. 10,450,658.

(60) Provisional application No. 62/746,241, filed on Oct. 16, 2018, provisional application No. 61/989,228, filed on May 6, 2014.

(51) Int. Cl.

| | |
|---|---|
| ***C23C 8/22*** | (2006.01) |
| ***C21D 1/18*** | (2006.01) |
| ***C23C 8/02*** | (2006.01) |
| ***C21D 10/00*** | (2006.01) |
| ***C21D 8/02*** | (2006.01) |
| ***C23F 17/00*** | (2006.01) |
| *C23G 1/08* | (2006.01) |

(52) U.S. Cl.

CPC ..... *C23C 8/22* (2013.01); *C21D 1/18* (2013.01); *C21D 8/0257* (2013.01); *C21D 10/00* (2013.01); *C23C 8/02* (2013.01); *C23F 17/00* (2013.01); *C21D 2241/00* (2013.01); *C23G 1/08* (2013.01)

(58) Field of Classification Search

CPC .... C23C 8/22; C23C 8/02; C21D 1/18; C21D 10/00; C21D 8/0257; C23F 17/00

See application file for complete search history.

(56) References Cited

U.S. PATENT DOCUMENTS 5,556,483 A * 9/1996 Tahara ..... C23C 8/34 148/206

* cited by examiner

*Primary Examiner* — Jessee R Roe

(74) *Attorney, Agent, or Firm* — McDonald Hopkins LLC

(57) ABSTRACT

A carburization method for steel is contemplated, with austenitic stainless steel showing particular promise. The surface is first passivated with an acidic solution and then subjected to low temperature (between ~350 to 550° C. or between ~650 to 1,000° F.) carburization in the presence of a concentrated carbon solution (e.g., carbon monoxide, hydrogen gas, and nitrogen gas), followed by a repeated cycle of passivation and carburization under identical conditions but for a comparatively shorter period of time relative to the first cycle. The carburized surface is allowed to cool and cleaned, after which the resulting surface is shown to have ultrahigh tensile strength, increased interatomic bonding strength, and lowered electrical and thermal conductivity. To the extent this method can be employed to completely saturate and penetrate the workpiece (e.g., a foil), the resultant material and article are formed entirely from a novel composition.

11 Claims, 8 Drawing Sheets

METAL CARBURIZATION PROCESS TO PRODUCE A UNIFORM, CONCENTRATED SOLID SOLUTION OF INTERSTITIAL CARBON WORKPIECE AND ARTICLES MADE FROM SAME

REFERENCE TO RELATED APPLICATIONS

This application claims priority to U.S. Provisional Patent Application Ser. No. 62/746,241 filed on Oct. 16, 2018. Additionally, this application is a continuation-in-part of U.S. patent application Ser. No. 15/308,223 (now granted as U.S. Pat. No. 10,450,658), filed on May 6, 2015 and claiming its priority to U.S. Provisional Patent Application Ser. No. 61/989,228, filed on May 6, 2014. All of the foregoing applications are incorporated by reference herein.

TECHNICAL FIELD

Aspects of the invention relate generally to the surface treatment of metals and, more particularly, to a carburization method to improve the tensile strength and other properties along the surface of the carburized metal.

BACKGROUND

Low-temperature carburization (or "LTC") has been under development for more than two decades as an effective surface treatment to enhance the performance of alloy parts. This technique has been applied to a broad spectrum of alloy systems, including Fe-based alloys, Ni-based alloys, and Co—Cr-based alloys. The principle of LTC is to infuse concentrated interstitial solute, e.g. carbon, through the alloy surface at temperatures where interstitial diffusion is rapid while substitutional diffusion is slow enough to suppress the formation of secondary phases (carbides), which would degrade the corrosion resistance.

Taking AISI-316 austenitic stainless steel (AISI-316) as an example, it has been reported that LTC can generate a "case" (carbon-rich subsurface zone) consisting of a uniform solid solution of concentrated interstitial carbon. Carbon atom fractions in excess of 0.1 can be routinely achieved. In industrially applied processing, the mean depth of carbon is 10 μm. Earlier studies have demonstrated that the case forms highly conformal to even complex alloy part shapes and induces only minimal changes in part dimensions.

According to numerous studies, LTC substantially improves a variety of alloy properties. In AISI-316, the high carbon level in the case generates a surface hardness >1000HV25 and biaxial residual compressive stress >2 GPa, both of which enhance wear resistance of up to orders magnitude (relative to the non-treated surfaces at room temperature). The tensile properties of the carburized AISI-316 suggest increased the yield stress and a decrease in strain to failure. The "case" formed by carburization appears to provide wear resistance compared to non-treated AISI-316 under both potentiodynamic and potentiostatic conditions. LTC is also believed to increase the endurance limit (stress at the fatigue life of $10^7$ cycles) from 0.20 to 0.35 GPa while dramatically enhances the corrosion resistance.

However, evidence may suggest some limitations. For example, the mild wear regime of AISI-316 might be attributed to more extreme tribological conditions. Also, at least one study suggested LTC processes increase the pitting potential of the carburized sample in comparison to non-treated samples.

To the inventors knowledge, no work to date has focused on understanding the intrinsic physical and mechanical properties of the CSSIC (concentrated solid solution of interstitial carbon). This is especially true for the tensile properties of carburized AISI-316 because in previous mechanical testing, the ratio of mean carbon depth to foil thickness η was small, meaning that only a small fraction of the cross-section of the tensile specimen consisted of carbon solution. Moreover, LTC generally produces a graded carbon-fraction-depth profile $X_C[z]$. Accordingly, the measured properties do not reflect the intrinsic tensile properties of the carbon solution and are complicated by the grading of the $X_C[z]$ and the interaction between the carbon solution and the non-carburized alloy core through a diffuse interface. To evaluate the intrinsic, independent tensile properties of the carbon solution and understand how zones of different carbon fraction contribute to the tensile properties of AISI-316 after LTC requires (i) specimens consisting entirely of carbon solution with a uniform carbon level and (ii) partially carburized specimens (consisting of carbon solution and core) with different ratios η.

SUMMARY OF INVENTION

A carburization method for steel is contemplated, with austenitic stainless steel showing particular promise. The surface is first passivated with an acidic solution and then subjected to low temperature (between ~350 to 550° C. or between ~650 to 1,000° F.) carburization in the presence of a concentrated carbon solution (e.g., carbon monoxide, hydrogen gas, and nitrogen gas), followed by a repeated cycle of passivation and carburization under identical conditions but for a comparatively shorter period of time relative to the first cycle. The carburized surface is allowed to cool and cleaned, after which the resulting surface is shown to have ultrahigh tensile strength, increased interatomic bonding strength, and lowered electrical and thermal conductivity. To the extent this method can be employed to completely saturate and penetrate the workpiece (e.g., a foil), the resultant material and article are formed entirely from a novel composition.

Specific reference is made to the appended claims, drawings, and description, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

FIG. 4(*b*) is a schematic depiction of the crystal structure of the untreated foil, while FIG. 4(*c*) is a similar schematic depiction of LTC foil (shown on a relative scale compared to FIG. 4(*b*)) where all octahedral interstitial sites occupied by concentrated carbon and the expansion of the lattice parameter is indicated by Δa.

DETAILED DESCRIPTION OF INVENTION

Figure 1:
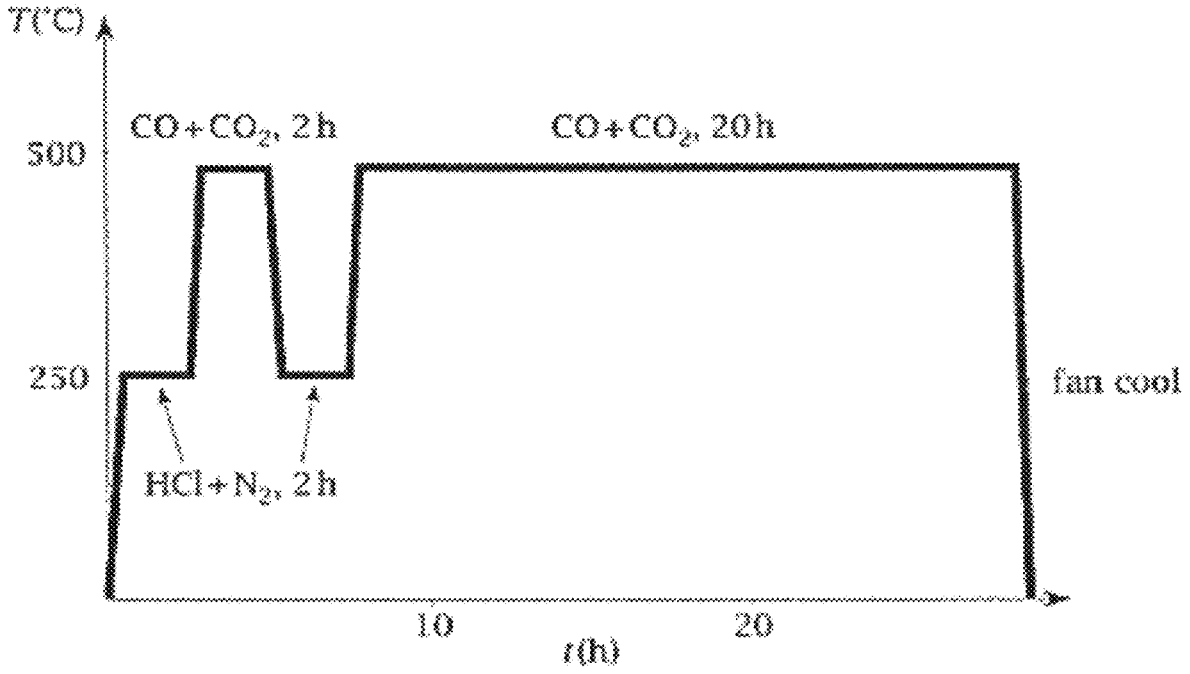
FIG. 1 s a temperature-time diagram suggesting one method of LTC from the prior art.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

The inventors have identified intrinsic properties of the carbon-rich subsurface zone ("case") that low-temperature carburization generates in austenitic stainless steel (AISI-316). Foils of this steel were carburized according to the methods contemplated herein to obtain concentrated interstitially dissolved carbon distributed uniformly throughout their thickness. Compared to the as-received AISI-316 foils, carburization increases the ultimate tensile strength to 3 times, the yield strength to 4 times, and the effective Young modulus to 1.5 times, respectively. On the other hand, the strain to failure decreases to (9±1)×10-3.

For comparison, foils with larger thickness were carburized according to these methods as well. Those foils retained a core of low carbon level. Decreasing the ratio of mean carbon depth to foil thickness was found to decrease the ultimate tensile strength, yield strength, and elastic modulus, while increasing the strain to failure. Tensile testing partially carburized foils to failure confirmed ductility in the core, but revealed reduced ductility in the carbon-rich zone near the surface. On the surface, intergranular cracks were observed to propagate perpendicular to the tensile direction, indicating brittle fracture initiated by cracks nucleating at grain boundaries. The isolated concentrated solid solution of interstitial carbon in austenite can be regarded as a new material with exceptional properties, particularly ultrahigh tensile strength, high yield strength, and high Young's modulus.

Generally speaking, the goal of these actions was to transform the entire composition of the workpiece (i.e., the foil) so as to create a composition that was distinct from the starting material. The benefits of this composition are identical to those produced in the case (i.e., the surface) of conventionally treated LTC materials. However, unlike conventional LTC materials, the workpieces contemplated herein do not possess a core or layer that is distinguishable from the case. As such, certain aspects of the invention embrace a composition and articles consisting essentially of this new material.

In certain other aspects of the invention, AISI-316 austenitic stainless steel foils with four different thicknesses were chosen in order to prepare LTC'd specimens with different ratios η under otherwise constant conditions. Following procedures outlined in U.S. Pat. No. 10,214,805,16 and/or U.S. patent application Ser. No. 15/308,223 (the latter of which provides priority for all portions of this disclosure relating to these procedures and both of which are fully incorporated by reference as part of the disclosed invention herein), the foils were carburized at low temperature and then characterized to determine the carbon-fraction-depth profiles $X_C[z]$ and the hardness-depth profiles $H_n[z]$. Comparative measurements of tensile properties were carried out on carburized as well as non-treated reference specimens, including measurements of the ultimate tensile strength, yield strength, elastic modulus, and strain to failure. Fractography was also conducted to compare the fracture mechanisms of carburized and non-treated AISI-316 foils.

Generally speaking, the LTC procedure generates a solid solution with extremely high spatially uniform levels of carbon (i.e., about ≥10 atomic %) which is effectively a new material in comparison to the original workpiece. Austenitic stainless steels and, more specifically, AISI-316 and/or AISI-316L steels, are particularly useful and amenable to this approach. The resultant new material has excellent corrosion resistance in saltwater environments, comparable to the most expensive corrosion resistant alloys and much better than the corrosion resistance of the original stainless steel. Moreover, it is stronger, stiffer, and lighter. It is three times stronger than AISI-316, has four times the yield strength, and 1.5 times the Young modulus. As such, it holds promise for various applications, including but not limited to stents, surgical tools, shaving razors, precision cutting tools, and the like.

Surgical stents and other surgical or cutting implements are particularly interesting. To the extent performance of stents can be improved by reducing strut thickness (e.g., thinner struts have been shown to greatly improve healing rates and enhance vasomotion and arterial wall function after stenting), the new material can overcome existing problems in which the strength of current materials is insufficient and, therefore, cannot withstand the required forces. Thus, in certain aspects of the invention, a surgical stent made from the materials disclosed herein is contemplated. More generally, additional aspects embrace articles related the other applications identified above for many of the same reasons that stents hold particular promise.

Methods of making all of these articles (i.e., stents, surgical tools, razors, etc.) are also contemplated. In each case, the method comprises providing a workpiece, treating the workpiece according to any of the LTC processes contemplated herein, and forming the workpiece into the desired article. The forming may involve any number of metal working procedures known in the art, such as machining, welding, cutting, milling, threading, filing, grinding, brazing, riveting, providing fasteners, and the like. The workpiece may be provided as a foil, a sheet, a tube, or in any other form, so long as that form is amenable to the LTC procedure (and produces the new material) contemplated herein.

The LTC procedure begins with a surface activation treatment. It was found that, for many alloys, the native alloy surface is not transparent for inward diffusion of interstitial solute (carbon or nitrogen) at the (low) temperatures. Thus, this step makes the surface transparent to inward-diffusing interstitial solute atoms. In some embodiments, this may be accomplished with the use of HCl gas mixed with nitrogen gas. In other embodiments, an aqueous acid solution may be used, with the concentration of the acid can be varied in order to produce desired surface activation. Various aqueous acids can be utilized in the practice of the present invention including, but not limited to, hydrochloric acid, hydrofluoric acid, hydrobromic acid and sulfuric acid. The concentration of the acid, the immersion time, and the temperature of the acid need to be adjusted for completely removing the passivating layer from the alloy surface while, at the same time, minimizing damage to the alloy part, e.g. by removal of alloy material below the passivating layer or pitting. The suitable range of acid concentrations corresponds to the pH range from +4 to −1. The acid may contain wetting agents and/or components for buffering the pH value or controlling viscosity.

This initial activation step is conducted at elevated temperatures for extended periods of time. Suitable ranges for etching time are between 1 s and 90 ks (~1 day), with ranges focused around 10 ks, +/−2 ks for the initial activation step. The suitable range of etching temperature is between about 220 K (−50° C.) and 380 K (100° C.) for aqueous acids and between about 420 K (~250° C.) and 625 K 450° C.).

It is also noted that surface activation or depassivation step can be performed utilizing other techniques for activating stainless steel and other metal articles prior to the process for preventing formation of the oxide layer by immersion in or coating with the post-passivation liquid. Examples include contacting the workpiece with a hydrogen halide gas such as HCl or HF at elevated temperature (e.g. 260° to 450° C.), contact with a strong base, electroplating with iron, contact with liquid sodium and contact with a molten salt bath including sodium cyanide.

Cleaning procedures, such as submersion in ethanol or other alcohols or solvents followed by ultrasonic exposure and subsequent rinsing with distilled water or other solvents, can precede the activation step in order to remove grease, dirt, and other unwanted surface impediments and contaminants. Similar cleaning procedures can be used after the LTC procedure to remove soot.

Immediately after activation, an LTC procedure is employed. This procedure is conducted at elevated temperature for selected periods of time. Suitable temperatures range from between ~350 to 550° C. or between ~650 to 1,000° F. Further, this carburization is conducted in the presence of a concentrated carbon solution (e.g., carbon monoxide, hydrogen gas, and nitrogen gas). In some aspects, the carbon and hydrogen gases are provided at equivalent atomic amounts, while the nitrogen is provided at only a fraction thereof (e.g., less than one half, less than one quarter, and/or at about or less than two tenths). Additional details can be gleaned from the examples, which form part of this overall disclosure.

After LTC, the samples are cooled to room temperature. In some aspects, the cooling step can proceed under ambient conditions. Cleaning procedures may be included prior to the initial activation and subsequent to the final LTC procedure.

Notably, a second or multiple cycles of activation and LTC can be used. In one embodiment, the first or initial cycle proceeds at longer times in comparison to the second and/or subsequent cycles. Further, the activation and LTC procedures within a cycle can proceed at the same or nearly the same (+/−10%) time range.

In a further embodiment, after the activation step, the article (or at least portions thereof) is contacted with or immersed in a liquid that prevents or significantly retards the formation of an oxide layer (e.g., chromium-rich oxides), on a surface of the article. This step could also be employed between the activation and LTC procedures in a cycle, so that he article or alloy remains immersed or otherwise coated with the liquid on desired surfaces thereof until the article can be subjected LTC. Suitable liquids include, but are not limited to, alcohol (such as but not limited to ethanol), water, oil, or fatty acids (such as but not limited to a mixture of iso-octadecanoic acid, iso-tridecanoic acid, and 2-butyl octanoic acid).

In another significant aspect where liquids are used in post-passivating, the post-passivating solution has a suitable boiling point that allows the solution or residuals thereof to evaporate upon heating in the carburization process. Suitable boiling points range from about 50 to about 500° C., and preferably from about 300° to about 450° C. Immersion of the article can be maintained for convenience and/or handling purposes until the article is ready to be subjected to the carburization process or any other desired processing step. In another aspect, the post-passivating liquid tends to wet the alloy surface. Thus, the post-passivating liquid may contain suitable wetting agents or other non-reactive components to adjust the boiling point as desired.

Notably, by selecting a workpiece of sufficient thickness and composition (e.g., AISI-316 foils), it becomes possible to transform the workpiece into a uniform item having a unique composition, relative to the starting material. As described in more detail below, this unique composition has extraordinary and unexpected properties above and beyond a typical "case hardened" surface treatment for that material (where an inner core exists as a distinct substrate layer, meaning that the surface treated material still possesses the properties and disadvantages of the original starting material).

Thus, the inventors believe the processes producing this new material hold promise for developing new metal compositions for use in articles such as stents, surgical tools, razors, and the like. In particular, the increased strength of the new material should enable improvements to these articles that can lead to more robust uses and/or cost savings associated with a reduction in the amount of metal required for manufacturing these articles.

One aspect of the invention includes a composition of solid solution, fully carburized metal as described and characterized below. Notably, this composition is completely free from any layers or surface-only treatments as had been produced by previous LTC and other hardening methods.

Another aspect of the invention is a method of making articles formed from these metals. Here, it is important to ensure that parameters for activation, LTC, and the composition and thickness of the workpiece itself are carefully selected to ensure no residual "substrate layer" remains after the processes contemplated herein. The examples below provide concrete guidance in this regard, although these examples are not necessarily limiting to this aspect of the invention. Further modifications, particularly relying upon disclosed alternatives for activation and/or LTC (as well as the manufacturer's knowledge of available materials and how these selected steels and alloys might otherwise receive surface treatments), enable the creation of a range of workpieces that can be used to make articles of interest.

In summary, the process produces a concentrated solid solution of interstitial carbon in austenitic or other metals/steel. The resultant workpiece does not possesses any underlying substrate layer, thereby imparting ultrahigh tensile strength, high yield strength, and high Young's modulus. These improved tensile and yield strengths, as well as the high Young's modulus are all relative to the original starting metal, with possible improvements as disclosed in the Examples below and/or by showing improvements of at least 1%, at least 2%, at least 5%, at least 10% or more relative to the original metric for the starting material.

While AISI-316 steels are of particular interest, other metals may be subjected to these same treatments. For example, other austenitic stainless steels, martensitic stainless steels, precipitation-hardened stainless steels, duplex stainless steels, and various alloys could be used. Specifically, articles comprising iron-, nickel-, cobalt-, or titanium-base alloy containing alloying elements (e.g. chromium, manganese, titanium, aluminum) capable of forming a hardened surface layer or "case" by diffusing high concentrations of carbon, nitrogen, or other interstitial solute atoms into the material without formation of precipitates. The invention is particularly applicable to case hardening of steels, especially steels containing from about 5 to about 50 weight percent nickel and about 10 to about 50 weight percent chromium. In one embodiment a metal alloy contains 10 to 40 weight percent nickel and 10 to 35 weight percent chromium. Also preferred are stainless steels, especially the AISI 300 series steels, superaustenitic stainless steels, precipitation hardened stainless steels, martensitic stainless steels, duplex stainless steels, and Ni-base and Co-base alloys. Of special interests are the AISI-316, 316L, 317, 317L and 304 stainless steels, alloy 600, alloy C-276 and alloy 20 Cb, to name a few non-limiting examples.

Examples

The as-received materials were foils of AISI-316 austenitic stainless steel (McMASTER-CARR®, Aurora, Ohio). The foils had been cold worked and tempered. Their specifications (chemical composition, tensile properties etc.,) meet the requirements specified in ASTM A240 and ASTM A666. Foils with four different thicknesses were selected. The selection was based on the typical mean carbon depth of 10 μm in industrial products. The thickness of the as-received foils was measured to (25.4±0.5)μm, (49.5±1.3) μm, (76.1±0.1)μm, and (98.8±2.24) μm by both cross-sectional microstructure imaging and a micrometer with a precision of 3 μm. Ten specimens were prepared from each foil. One half of the specimens were treated by LTC, the other half was left as reference specimens.

Before LTC, the samples were submerged in ethanol in an ultrasonic cleaner to remove grease and contaminants, then rinsed in distilled water. Then, the specimens were transferred into a gas furnace for LTC. The process began with 10.8 ks of surface activation in an HCl and $N_2$ atmosphere at 523 K, followed by 10.8 ks of carburization in a CO, $H_2$, and $N_2$ atmosphere at 723 K, followed by another 10.8 ks of surface activation, then another carburization step for 72 ks, finally cooling the samples down to room temperature. After LTC, the samples were ultrasonically cleaned in the distilled water to shake off soot from the surface. The thickness of the so-prepared specimens was measured to be (27.3±0.7) μm, (52.7±0.7) μm, (79.4±0.7) μm, and (101.0±0.5) μm in a same way.

The as-received and carburized AISI-316 foils with different thickness were named as "AR-t" and "C-t". The letter codes "AR" and "C" stand for "as-received" and "carburized," respectively. The number t represents the foil thickness in multiples of 25 μm (1 mil). For example, "C-3" means a 75 μm thick AISI-316 foil treated by LTC.

After the treatment, the surface phase composition of as-received and carburized foils was analyzed using an X-ray diffractometer (Bruker Discover D8) operating with monochromatic Co—$K_{\alpha 1}$ ($\lambda$=0.179 nm) radiation. For other characterization, we prepared cross-sections polished with diamond suspension down to 0.1 μm. To evaluate the hardness, nano-indentation (Agilent G200 Nanoindenter) was conducted on the as-polished cross-sectional samples through their thickness with 0.5 μm as a fixed penetration depth and 10 s as a load application time. Then, the samples were etched by Marble's reagent to investigate their microstructure under a light-optical microscope (Leica DM2500 M). The elemental distribution along the cross-section of the sample was recorded by SAM (scanning Auger microprobe, PHI680) with a primary electron energy of 10.0 keV after 360 s Ar sputtering at 3 kV. The results were calibrated by relative sensitivity factors for each element and then normalized to reproduce the known composition in regions practically free of added carbon.

Figure 2A:
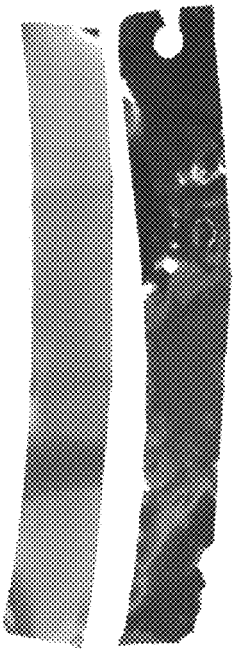
FIGS. 2(*a*) through 2(*d*) include side-by-side photographic comparisons of original, untreated foil (left image in each subset) and LTC foil according to certain aspects of the invention (right image).
Figure 2B:
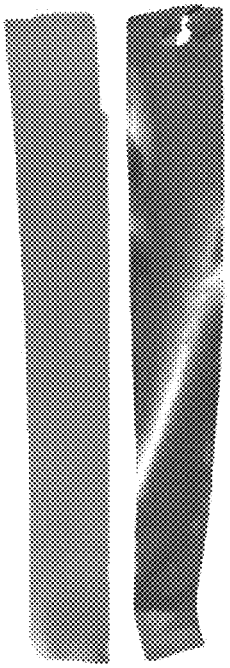
Figure 2C:
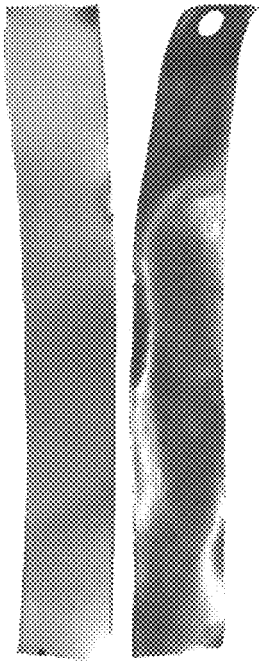
Figure 2D:
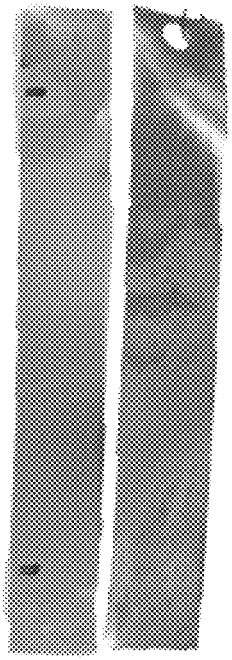
Figure 3A:
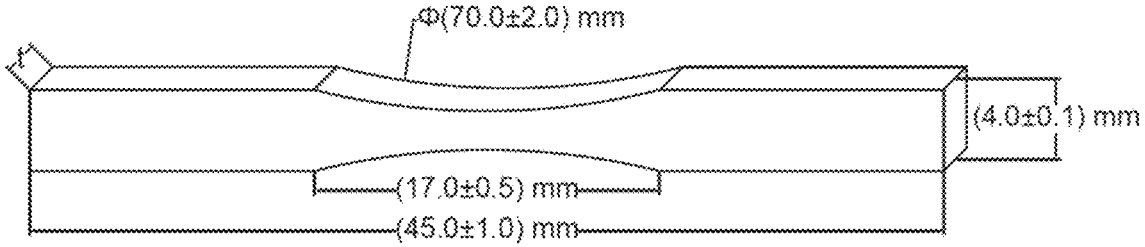
FIG. 3(*a*) is a schematic drawing showing the design of the tensile test piece, while FIG. 3(*b*) are exemplary photographs of specimens machined from the foils shown in FIGS. 2(*a*) through 2(*d*) and FIG. 3(*c*) is a photograph of one of the specimens in the tensile tester.
Figure 3B:
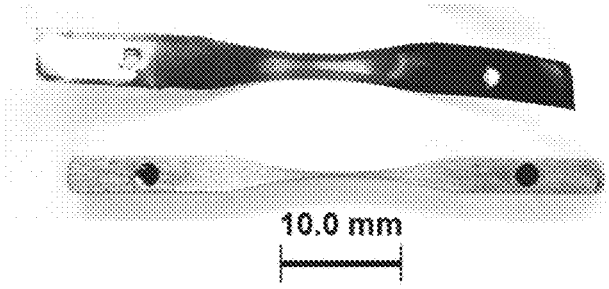
Figure 3C:
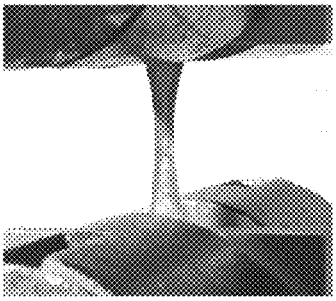

The tensile tests were carried out on a tabletop Instron (Instron 100# Tension S/N 983, FIG. 2*c*). Before testing, the equipment was calibrated by a known load (2.27 kg). The data acquisition rate was set to be 10 Hz and the strain rate of the test was set to 5 $ks^{-1}$, which was within the range (1-8 $ks^{-1}$) prescribed by ASTM E345-16. The shape of the tensile specimen, shown in FIG. 2*a*-2*b*, was designed differently from the standard considering the limitation of the grip size and load capacity of the equipment. To avoid stress concentration during the test, the fillet radii of the tensile specimen, (35.0±1.0) mm, was larger than the minimum value (19.0 mm) prescribed by the standard. Under the same experimental conditions, three specimens from each group were tested to obtain statistically significant results. To determine the fracture mechanisms, fractography was conducted using scanning electron microscopy (SEM) on the fractured surfaces as well as the carburized surfaces perpendicular to them.

FIG. 2 shows light-optical photographs of the foils with different thickness before and after LTC. Compared to the flat and smooth surface of the as-received foils, the surfaces of carburized foils exhibit curls and wrinkles. Thinner foils tend to be curlier and more wrinkled after LTC than thicker foils.

Figure 4A:
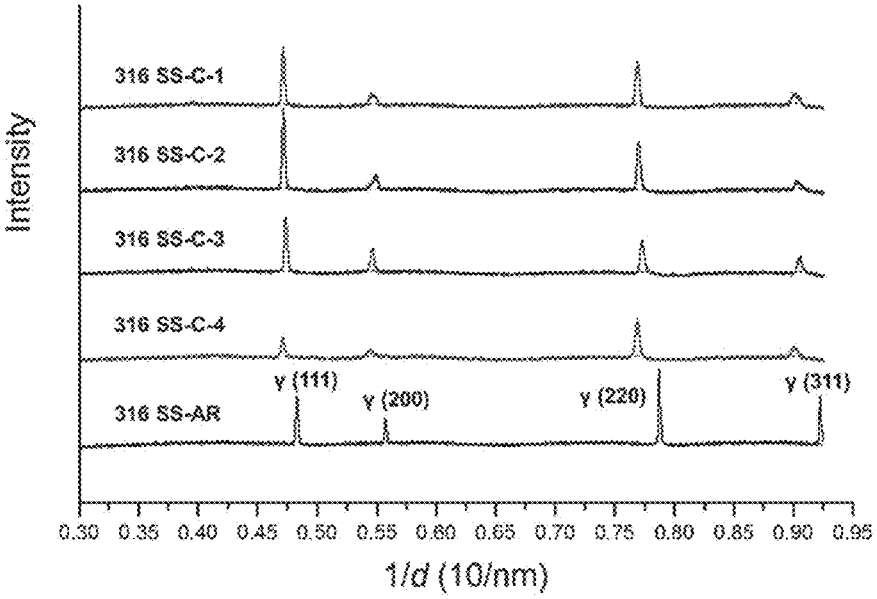
FIG. 4(*a*) is an x-ray defractometric (XRD) graph of various LTC pieces (316 SS C-1 through 316 SS-C-4) in comparison to an untreated foil (316 SS-AR).
Figure 4B:
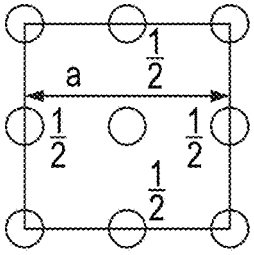
Figure 4C:
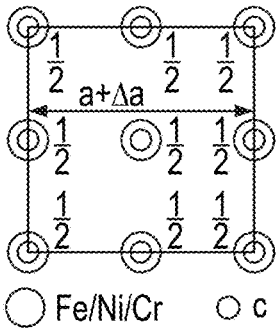
Figure 5A:
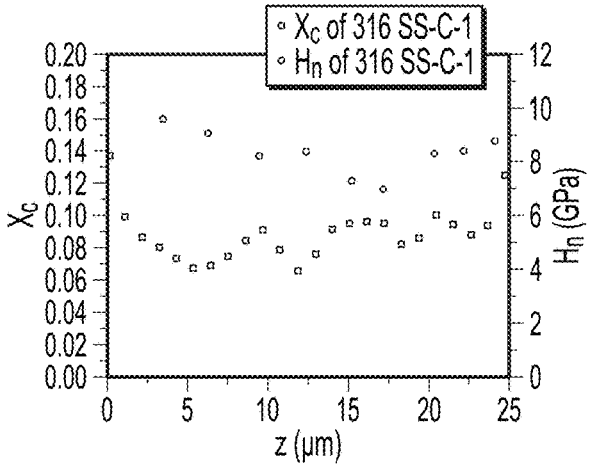
FIGS. 5(*a*) through 5(*d*) show the depth profiles $X_C[z]$ and Hn[z] of the carbon atom fraction Xc and the hardness Hn, respectively for samples C-1 through C-4 (as reported in FIG. 4(*a*)).
Figure 5B:
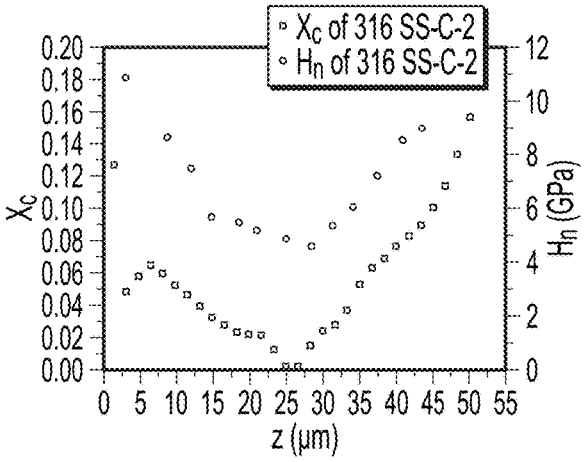
Figure 5C:
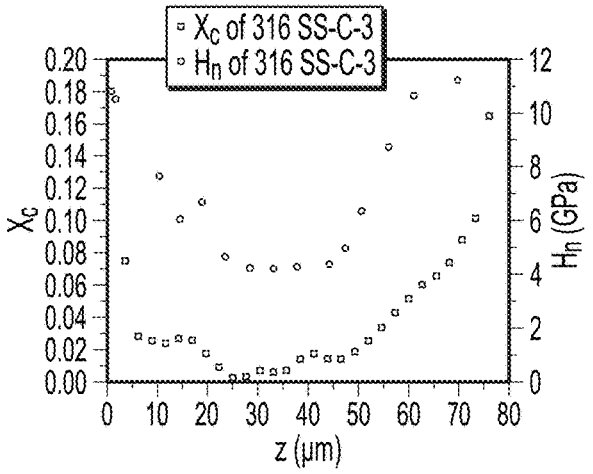
Figure 5D:
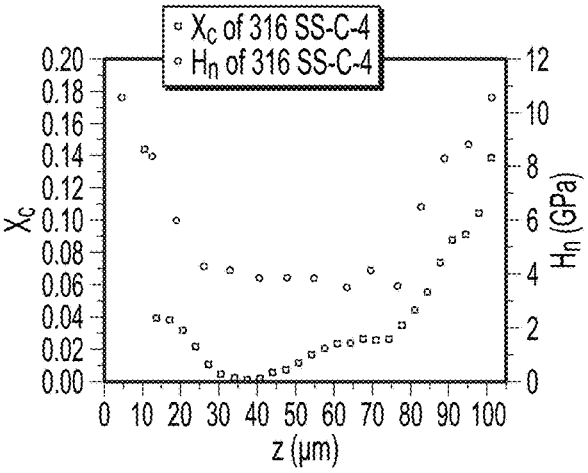
Figure 6A:
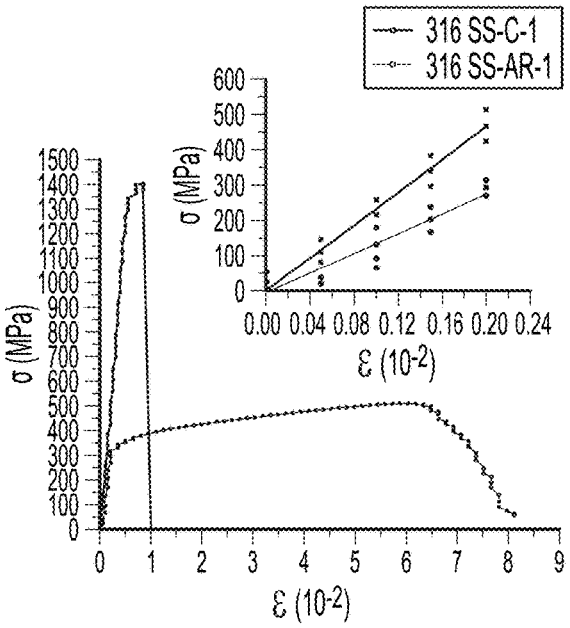
FIGS. 6(*a*) through 6(*d*) show engineering stress-strain curves, respectively for samples C-1 through C-4 (as reported in FIG. 4(*a*)), with the inset in each Figure being an enlargement of the region of elastic behavior.
Figure 6B:
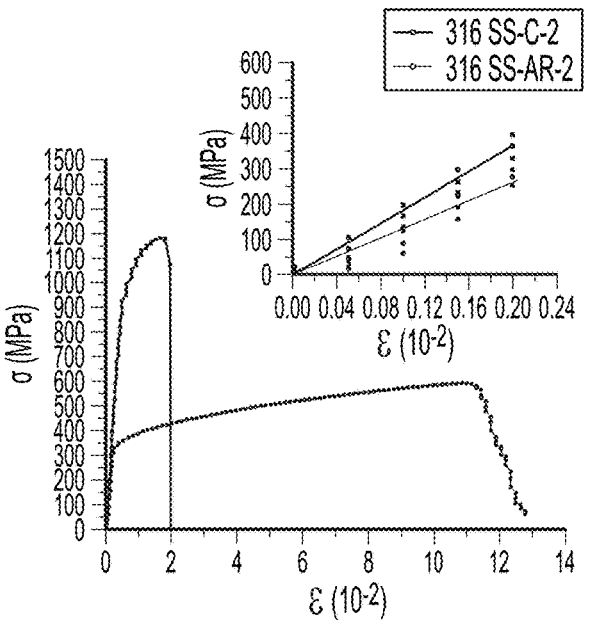
Figure 6C:
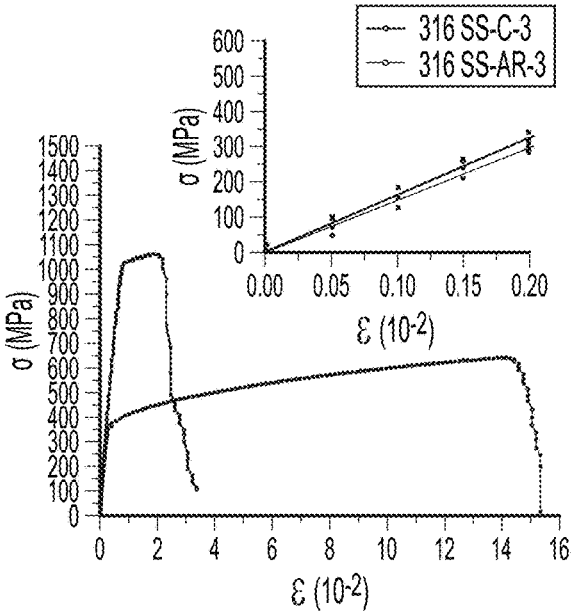
Figure 6D:
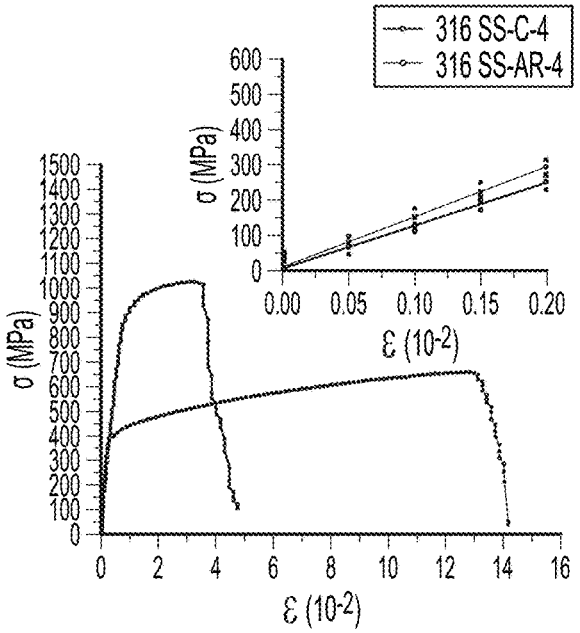
Figure 7A:
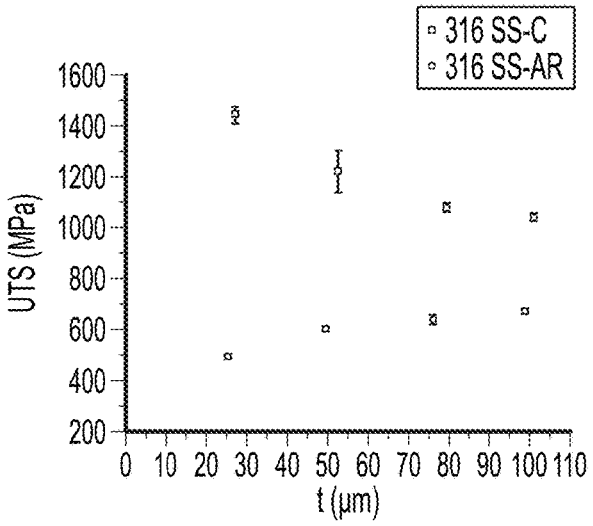
FIGS. 7(*a*) through 7(*d*) show various tensile properties extracted from the engineering stress-strain curve for sample C-1 in comparison to an untreated sample (AR) as follows: (a) Ultimate tensile strength UTS. (b) Elastic modulus E. (c) Yield strength $\sigma_y$, defined at 0.2% plastic strain. (d) Strain to failure $\varepsilon_F$.
Figure 7B:
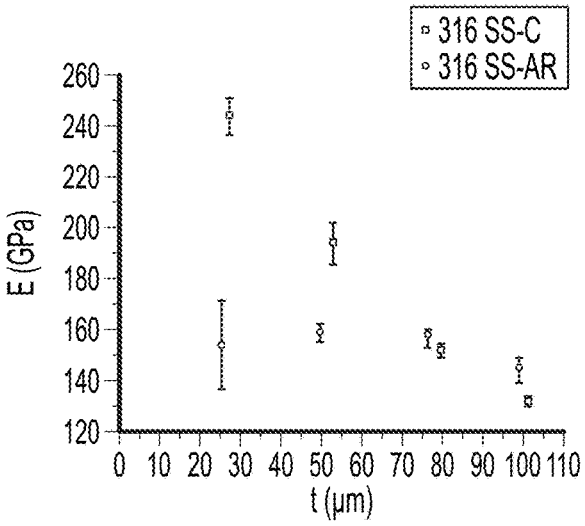
Figure 7C:
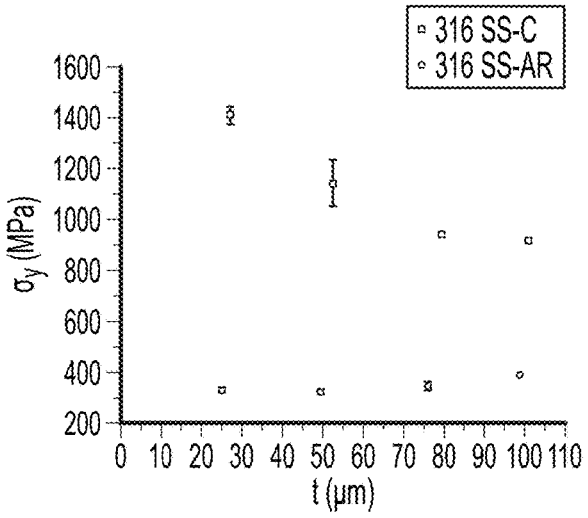
Figure 7D:
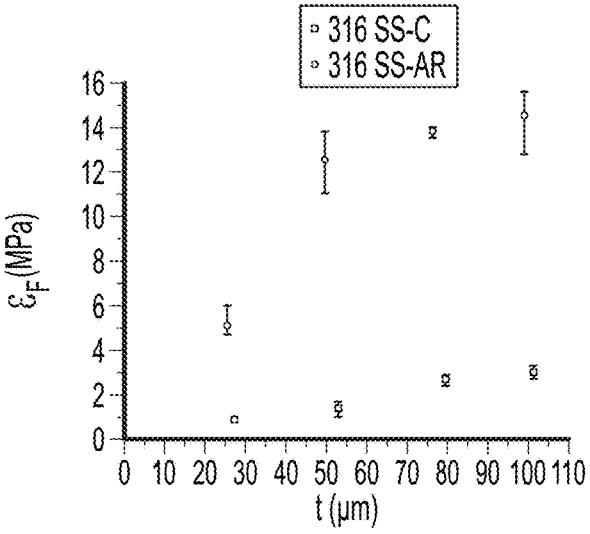
Figure 8A:
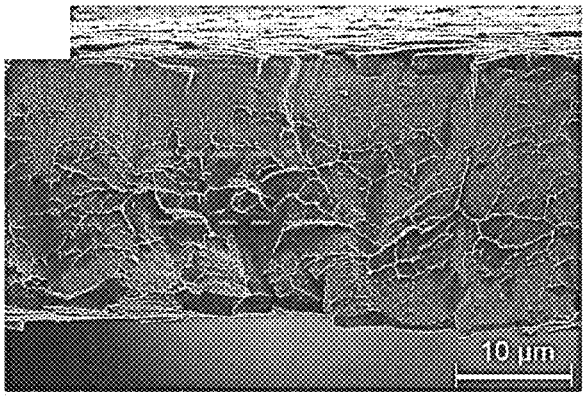
FIGS. 8(*a*) through 8(*d*) are scanning electron microscopic images respectively for samples C-1 through C-4 (as reported in FIG. 4(*a*)) for the fracture surfaces on each sample. The heavy black parallel lines in each image indicate the boundaries between regions of "cleavage faces" and "dimples".
Figure 8B:
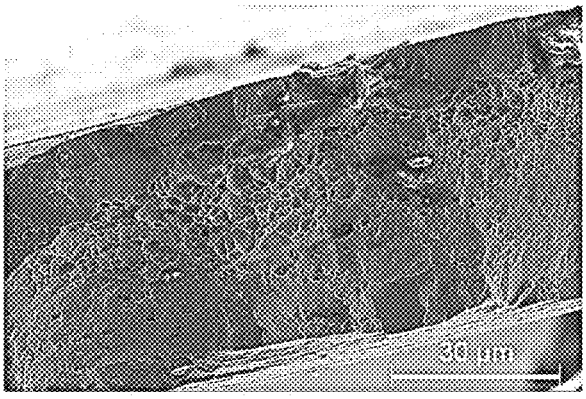
Figure 8C:
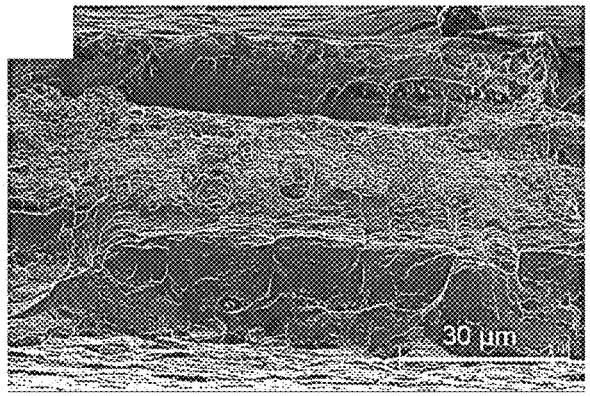
Figure 8D:
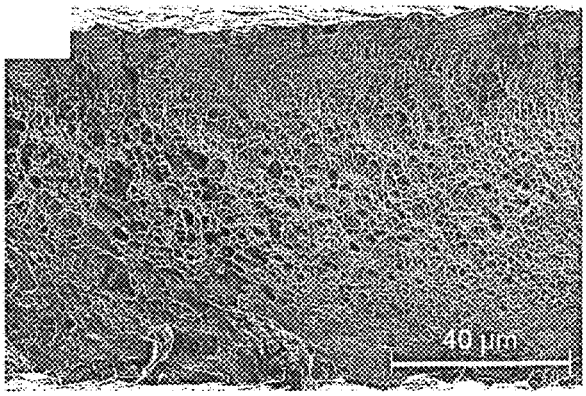
Figure 9A:
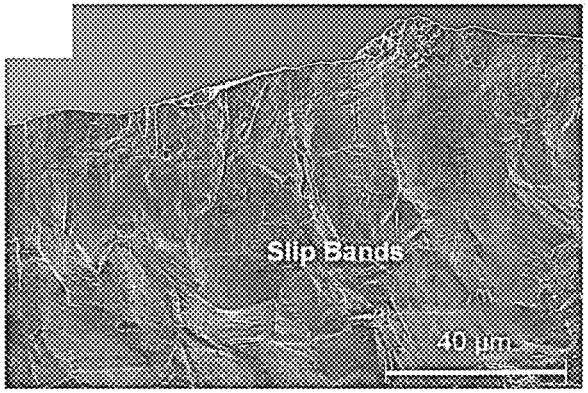
FIGS. 9(*a*) through 9(*d*) are scanning electron microscopic images for carburized surfaces perpendicular to the fracture surfaces on each sample, with integranular cracks and/or slip bands labeled accordingly, as follows: (a) shows the untreated foil (AR) (referenced in FIGS. 4 and 7), (b) is a more highly magnified image of (a), (c) shows sample C-2, and (d) is a more highly magnified image of (c).
Figure 9B:
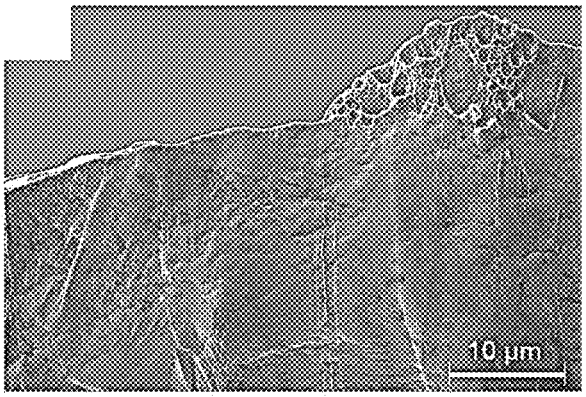
Figure 9C:
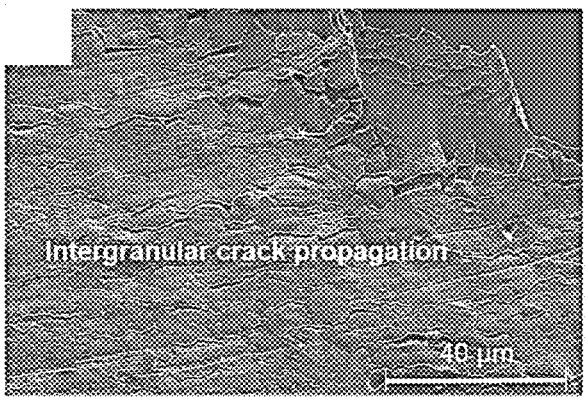
Figure 9D:
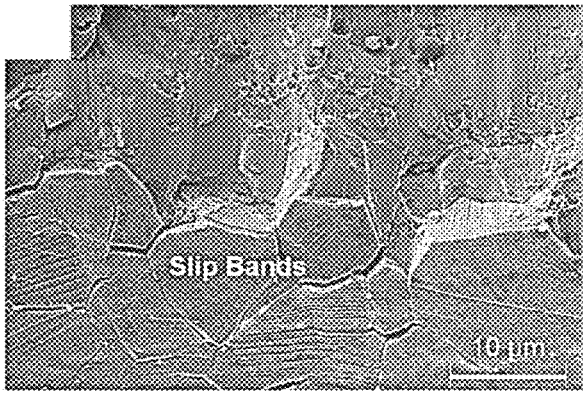

For phase-composition analysis, X-ray diffractograms of carburized and as-received foils were recorded, shown in FIG. 4. The patterns are plotted as a function of spatial frequency, i.e. the abscissa is independent of the X-ray wavelength. Within the recorded range, four characteristic peaks of austenite show up from the as-received foil, corresponding to the reciprocals of the plane spacings $d_{111}$, $d_{200}$, $d_{220}$, $d_{311}$. The diffractograms from the carburized foils exhibit the same peaks, but broader and with obvious shifts towards lower spatial frequencies, i.e. larger plane spacings. Apart from austenite peaks, no other peaks are observed, indicating that the volume fraction of hypothetical carbide precipitates, if they exist at all, is below the detection limit (~1 vol %) of XRD under the employed conditions. Apparently, all carbon atoms should reside in octahedral interstices of the austenite's A1 structure, as sketched in FIG. 4(*c*). According to our previous research on LTC of stainless steels, the peak shift originates from the interstitial solute expanding the interatomic spacings of the A1 structure. FIG. 4(*a*) indicates the corresponding changes of effective interplanar spacings, $d_{111}$, $d_{200}$, $d_{220}$, $d_{311}$. The peak broadening is a result of two effects: (i) The X-ray beam samples over depths of different carbon atom fraction, i.e. a (peak-index-dependent) depth interval of the smoothly graded carbon atom-fraction-depth profile. (ii) Stresses introduced by depth-dependent lattice parameter expansion cause dislocation activity and peak broadening related to dislocation-induced distortion of the atomistic structure. From each spacing $d_{hkl}$ of a set of {hkl} planes in the A1 structure, a lattice parameter $a_{hkl}$ can be calculated by $$a_{hkl}=d_{hkl}\sqrt{h^2+k^2+l^2}. \quad (1)$$

To correct the potential eccentric errors, e.g. related to specimen displacement, the Nelson-Riley correction was applied to determine the lattice parameter for each specimen. The corrected lattice constant ($a_{NR}$) was obtained by linearly extrapolating the plot of calculated lattice parameters versus Nelson-Riley function f[θ].

$$\frac{\Delta a}{a} = K \cdot f[\theta] \equiv K \cdot \left(\frac{\cos[\theta]^2}{\sin[\theta]} + \frac{\cos[\theta]^2}{\theta}\right). \quad (2)$$

Table 1 shows the lattice parameters calculated from the peak positions of each one of the four peaks observed in FIG. 4 and also the corrected lattice parameters by Nelson-Riley function. The corrected lattice parameter of the as-received foil is very close to the previously reported lattice parameter (0.35935(1)) of AISI-316 austenitic stainless steel. Compared to the as-received foils, the lattice parameter of the carburized foils is generally expanded by 2.2-2.3% after LTC.

TABLE 1

Lattice Parameters of Carburized and As-Received Foils Calculated from Different Planes and Corrected by Nelson-Riley Function.

| | $a_{(111)}$/nm | $a_{(200)}$/nm | $a_{(220)}$/nm | $a_{(311)}$/nm | $a_{NR}$/nm |
|---|---|---|---|---|---|
| AR | 0.35935 | 0.35971 | 0.35939 | 0.35933 | 0.35934 |
| C-1 | 0.36852 | 0.36765 | 0.36828 | 0.36770 | 0.36774 |
| C-2 | 0.36852 | 0.36496 | 0.36781 | 0.36729 | 0.36724 |

TABLE 1-continued

Lattice Parameters of Carburized and As-Received Foils Calculated from Different Planes and Corrected by Nelson-Riley Function.

| | $a_{(111)}$/nm | $a_{(200)}$/nm | $a_{(220)}$/nm | $a_{(311)}$/nm | $a_{NR}$/nm |
|---|---|---|---|---|---|
| C-3 | 0.36774 | 0.36697 | 0.36733 | 0.36729 | 0.36717 |
| C-4 | 0.36852 | 0.36832 | 0.36828 | 0.36770 | 0.36771 |

$a_{(hkl)}$: lattice parameter calculated from (hkl).
$a_{NR}$: lattice parameter correlated by Nelson-Riley function.

To analyze the atom-fraction-depth profiles $X_C[z]$ of interstitial carbon, we employed Auger electron spectroscopy on polished cross-sections of specimens. The $X_C$ of each specimen was obtained by normalizing spectral intensity of carbon with elemental sensitivity factors, calibrated by the as-received AISI-316 with known composition. FIG. 5 shows the results. From the $X_C[z]$ of C-1, FIG. 5(*a*), concentrated carbon with an atom fraction between 0.12 and 0.14 is observed within 1 μm below the carburized surfaces. In the core of the foil, a lower carbon fraction is found, in the range between 0.06 and 0.10. The carbon atom fraction decreases from the both sides of the foil towards the interior, as expected for carbon infusion from the surface. The plot also shows the hardness-depth profile $H_n[z]$ measured on the cross-section of C-1. Similar to the $X_C[z]$, the $H_n[z]$ exhibits a positive parabolic shape. The hardness near the surface is 9-10 GPa, while in the core it is 7-8 GPa. Both values are higher than the hardness of 4 GPa measured for the corresponding non-carburized specimen. C-2 (FIG. 4*b*), similar to C-1 (FIG. 4*a*,), features carbon fractions $X_C$=0.12 and $X_C$=0.16 directly below the carburized surfaces. With increasing depth z, $X_C$ gradually drops to reach a level near zero along the central plane of the foil. The hardness-depth profile $H_n[z]$ follows the same trend. It decreases from 11 GPa on both sides to around 4 GPa along the core plane of the foil. For the carbon-fraction-depth profiles of C-3 (FIG. 4*c*) and C-4 (FIG. 4*d*), similar features are expected as for C-2, just with a broader central low-carbon zone. Indeed, the carbon fraction drops to close to the as-received level at z 25 μm below the surfaces to leave a central layer of the foil as a "non-carburized" core. The hardness-depth profiles of C-3 and C-4 show the same trend with the carbon atom fraction. Idealizing the above observations, C-1 was "fully" carburized, though with a slightly non-uniform carbon-fraction-depth profile, and represents pure carbon solution. C-2, C-3, and C-4, in contrast, were "partially" carburized. In each specimen, significantly increased carbon levels are observed to a depth z≈25 μm on each side. The hardness-depth profiles correlate with the carbon-fraction-depth profiles.

All $X_C[z]$ and $H_n[z]$ profiles in FIG. 5 feature significant deviations from the expected mirror symmetry with regard to the central foil plane. The deviation $X_C[z]$ and $H_n[z]$ data acquired at symmetrically equivalent z positions is significantly larger than the typical variation of $X_C[z]$ and $H_n[z]$ between neighboring z positions. Therefore, the deviations from mirror symmetry cannot be interpreted as random noise in the compositional analysis or hardness measurement.

FIG. 6 presents the engineering-stress-strain curves of all C and AR specimens. All curves start with a linear section reflecting purely elastic deformation (insets in FIG. 6), followed by a section governed by plastic deformation. Generally, specimens treated by LTC exhibit higher tensile strength than non-treated specimens, but less ductility. With increasing foil thickness t, i.e. decreasing ratio η between the mean carbon depth and the foil thickness, the tensile strength of the foils decreases and the strain to failure increases, i.e. overall they become more ductile. The linear portions of the stress-strain curves exhibit a higher effective Young modulus E for carburized than for non-carburized specimens. This difference is most notable comparing the "fully" carburized foil to the corresponding non-carburized foil, FIG. 5*a*. As η decreases, E decreases toward the value measured for non-carburized specimens. Unexpectedly, however, C-4 exhibits a lower E than AR-4. For a quantitative analysis, corresponding tensile properties were extracted from the stress to strain curves and are presented in FIG. 7.

The tensile strengths of C and AR specimens are plotted in FIG. 7(*a*). Overall, the carburized foils exhibit higher tensile strength than the as-received foils. For the fully carburized C-1, the UTS (ultimate tensile strength) is (1445±40) MPa, which is nearly three times as high as (496±10) MPa of AR-1. This value is comparable with, or even higher than, the strength reported for ultrahigh-strength steels, such as nanoprecipitate-strengthened ultrahigh-strength stainless steel with an UTS of (1270 to 1600) MPa, nanocrystalline 316 L austenitic stainless steel foil with around 15 μm thickness, prepared by surface mechanical attrition with an UTS of (1550±80) MPa, or ultrahigh-strength nano-grained 304 stainless steel with an UTS of 1440 MPa. Besides, comparing to other methods of preparing ultrahigh-strength steels, e.g. surface attrition with post-exfoliation from the bulk by electro-discharging and multiple stages of quenching, cold rolling, and annealing processes, LTC is more energy efficient being a one-step process. As η decreases, the incremental effect of the case on tensile strength fades away. The UTS of C-2 is (1223±80) MPa, which is over two times as high as (601±5) MPa of the AR-2. C-3 has a UTS of (1077±30) MPa, while that of AR-3 is (639±19) MPa. For the thickest specimen, the UTS of C-4 is (1039±12) MPa, which is still about one and half times as high as (672±14) MPa of AR-4.

The effective Young modulus E, plotted in FIG. 7(*b*), is derived from the slope of the linear portion of the stress-strain curves. While the as-received specimens with different thickness exhibit E values in a narrow range of (140 to 170) GPa, the measured E of carburized specimens with different thickness span a much larger interval. For the fully carburized C-1, E=(244±8) GPa, more than one and half times the value of (154±30) GPa obtained for AR-1. As η decreases, E decreases as well. In the order of increasing foil thickness, E drops from (194±6) GPa for C-2 to (152±2) GPa for C-3, the value of which is comparable to the non-carburized specimens. Interestingly, C-4 exhibits a lower E than AR-4: (132±2) GPa vs. (145±5) GPa.

FIG. 7(*c*) shows the yield strength $\sigma_y$, defined as the stress at 0.2% plastic strain. Similar to the UTS, the $\sigma_y$ of the carburized foils also outperform those of the as-received foils. For the fully carburized C-1, $\sigma_y$=(1410±30) MPa. This is more than four times the $\sigma_y$ of AR-1, (330±10) MPa. The $\sigma_y$ of the fully carburized foil also surpasses, or is comparable to, some of the previously reported ultrahigh-strength steels, e.g. ultrahigh-strength nano-grained 304 stainless steel with a highest $\sigma_y$ of 1120 MPa, a nanocrystalline 316L stainless steel sample with $\sigma_y$ up to 1450 MPa. Also, the impact of carburized layer on the $\sigma_y$ decreases as the η drops. The $\sigma_y$ of C-2, C-3, and C-4 were (1137±90) MPa, (1030±50) MPa, and (960±50) MPa respectively, which are around two to three times as high as the as-received foils with a range of (330 to 390) MPa.

FIG. 7(*d*) shows the maximum strain that the foils could withstand before they failed, their engineering "strain to failure" $\varepsilon_F$. While LTC basically preserves ductility, carburized foils respond less ductile than as-received foils. For the fully carburized foil C-1, $\varepsilon_F=(9\pm1)\times10^{-3}$, significantly smaller than AR-1's $\varepsilon_F=(51\pm5)\times10^{-3}$. For the carburized foils, $\varepsilon_F$ increases as η decreases. For C-2, C-3, and C-4, $\varepsilon_F$ was measured to $(14\pm3)\times10^{-3}$, $(27\pm2)\times10^{-3}$, and $(30\pm3)\times10^{-3}$, respectively.

Overall, the carburized foils exhibit higher UTS, $\sigma_y$, and E compared to those of the as-received foils. At the same time, the carburized foils behave more brittle, i.e. exhibit a lower $\varepsilon_F$. These results demonstrate the possibility to tune the tensile properties of the AISI-316 austenitic stainless steel foils by controlling η.

Fractographs of carburized foils with the different thickness, recorded by SEM, are shown in FIG. 8. Two topographical patterns can be distinguished: one exhibiting cleavage faces, the other one exhibiting dimples. The heavy black lines in some of the images in FIG. 8 mark the boundaries between areas exhibiting these two distinctly different patterns. The dimple pattern indicates ductile rupture, while the cleavage pattern indicates brittle behavior. While the dimple pattern dominates in the center of the foils, the cleavage planes indicating brittleness dominates near the carburized surfaces. The area fractions of dimple regions in the fracture surfaces were quantified to be 0.27±0.03, 0.33±0.02, 0.44±0.04, and 0.53±0.04 for C-1, C-2, C-3 and C-4, respectively.

After the tensile tests, the carburized surfaces, perpendicular to the fracture surfaces, of both carburized and as-received foils were examined, as displayed in FIG. 9. For the as-received foil (FIGS. 9(*a*) and 9(*b*)), it is obvious that increasing plastic deformation increases surface roughness. Slip bands appeared on the carburized surface of the tensile test specimens. As expected, the slip bands form patterns of parallel lines ending at grain boundaries. Compared to the heavily roughened surface of the as-received foil, the surface of the carburized foils remained flat. On the side surfaces of the carburized foils, cracks were observed. Their propagation direction is perpendicular to the tensile direction, as shown in FIG. 9(*c*). The magnified region in FIG. 9(*d*) reveals intergranular cracks on the carburized surface of the foils.

LTC-induced surface wrinkling, especially of thin foils (FIG. 2), is likely related to irregularities in volume expansion and relaxation of related surface compressive stress. As reported in our previous research, compressive biaxial residual stress arises near the carburized surface because the high fraction of interstitial carbon expands the interatomic spacing in the "case" and this expansion is constrained by the non-carburized core. Considering that the foils are so thin that they leave either no or limited core to restrain the interatomic expansion, the compressive stress that initially built up at early stages where the carbon level was non-uniform, should be either partially or completely relaxed at the end of the process. A non-linear interaction may exist between carbon diffusion and curling: non-uniform carbon diffusion could curl the foil, while curling may locally enhance carbon diffusion. Practically, local variations e.g. by variation of Poisson contraction with local grain orientation, may also lead to the curling effect observed on the carburized surfaces. These effects may also explain the observed deviation of $X_C[z]$ and $H_n[z]$ from mirror symmetry.

To assess the reliability of measuring the Young modulus E, factors from both specimens and the test method need to be carefully analyzed. Firstly, consider the condition of the surface (phases, compositions etc.,), which will have a stronger impact on the mechanical properties of foils than those of bulk materials. The MSDS (materials specification data sheet) states that as-received foils may be mildly magnetic, though they were tempered after the rolling process. The mild magnetism appearing in the as-received foils was also verified from the magnetic hysteresis loops measured by vibrating-sample magnetometry (VSM, results not shown). We assume that this mild magnetism originates from residual martensite induced by the cold-working rolling. In another words, the as-received foils might be AISI-316 austenitic stainless steel with residual martensite. Considering no martensite peak appears in the X-ray diffractogram of the as-received foils, the volume fraction of the martensite should be less than the detection limit of XRD, estimated to 1 vol %. Partial transformation of austenite to martensite is known to increase the tensile strength and the elastic modulus of the alloy. On the other hand, diffusing concentrated interstitial carbon into the foils does not only strengthen the material, but also stabilizes austenite and may actually induce a reverse transformation from martensite to austenite. The decrease in saturation magnetization of the carburized foils compared to the as-received foils, which we observed by VSM, supports this hypothesis. In this mode, the observed increase of E is the net result of a decrease of the volume fraction of martensite and the increase of E induced by interstitial carbon. For a foil, especially C-1, it is obvious that the increased E reflects the properties of pure CSSIC. However, as $\eta$ decreases, the phase transformation from martensite to austenite could play a role. This can explain the "unexpected" result e.g. for the E of C-4. Beyond the effects discussed before, the reliability of measuring E can also be affected by the stiffness of the testing system etc.

The tensile test data indicate that LTC can provide significant mechanical strengthening (UTS and $\sigma_y$). Considering that martensite is stronger than austenite, the experimental observations may actually underestimate the true strengthening effect of carbon: if a small volume fraction of martensite actually exists and the infused carbon transforms it to austenite, the non-carburized material appears stronger than pure austenite, whereas the strengthening effect of martensite is reduced (or completely eliminated) after carburization. Significant strengthening of austenite by carbon is expected according to classical theories on solid-solution hardening: The localized stress/strain fields of interstitial carbon atoms causes parelastic and dielastic interaction with the stress field of dislocations, impeding plastic deformation by dislocation glide. It is believed that the critical shear stress $\tau_0$ increases proportional to $X_C^{2/3}$. As the hardness is governed by $\tau_0$, this suggests that the hardness should increase proportional to $X_C^{2/3}$.

As we have observed in earlier work, the hardness actually increases more progressively with $X_C$. Based on the dynamic modulus analysis (DMA), our earlier work also suggested that at the very high carbon concentrations in the case, a complex carbon-containing interstitial defect forms that interacts more strongly with dislocations than do isolated carbon interstitials. However, the current result of increased Young modulus cannot be explained by complex interstitial defects, suggests a different—or additional—strengthening mechanism.

We believe that the modulus is increased by covalent bonding between interstitial carbon and surrounding substitutional atoms. This belief is supported by theoretical work on the electronic structure of steel conducted by Gavriljuk, which confirms that interstitial carbon reduces the concentration of free electrons while increasing covalent bonding. As such, we conclude that the material produced by this process is a new material in its own right.

The fracture surface morphology patterns of cleavage planes and dimples (FIG. 8) can be understood in conjunction with the $X_C[z]$ (FIG. 5). The pattern of cleavage fracture appearing in the carbon solution zone indicates brittleness, in good agreement with the low $\varepsilon_F$ of the carbon solution observed in the tensile test (FIG. 6(*a*)). The decrease in $\varepsilon_F$ can originate from dislocation pinning by the concentrated carbon. The dimple pattern observed in the core region can be either non-carburized core or carbon solution with relative low carbon fraction. For the fully carburized C-1 (FIG. 8(*a*)), the dimple pattern appears in the center of the fracture surface, indicating local ductility, as reflected by its retained $\varepsilon_F$ (around 0.01).

For the as-received foils, the fracture surface with dimples and the highly deformed side surface indicate a fracture mechanism of ductile rupture. This mechanism is well studied and has three stages: (i) nucleation of internal voids during plastic flow, (ii) the growth of these voids with continued deformation, and (iii) their coalescence to produce complete rupture. However, after being infused with concentrated interstitial carbon, the AISI-316 foils show a different behavior, dominated by intergranular cracking, as observed in other high-strength steels. Generally, this indicates a mechanical strengthening of the grain interior compared to the typical mechanical strength of grain boundaries. Strengthening of the grain interior results from carbon impeding dislocation activity. The potential effect of carbon on the cohesion across grain boundaries deserves further investigation. After nucleating at the weak grain boundaries at high stress, cracks propagate into the alloy core and eventually cause failure of the specimen.

Surface engineering of AISI-316 by low-temperature carburization generates a subsurface zone with a concentrated solid solution of interstitial carbon in austenite. As it forms by diffusion and on a non-carburized core, the carbon-rich zone is under compressive stress and the carbon-fraction-depth profile is graded from the maximum carbon fraction at the surface toward the native carbon concentration of the non-carburized alloy core.

In view of the foregoing, for the first time, intrinsic, isolated properties of the carbon solution were studied without the underlying alloy core (substrate), at constant carbon fraction, and stress-free (or, at least, under significantly lower residual stress). The concentrated carbon solution in austenite constitutes a new material to the extent the substrate is no longer distinguishable, and this new material possesses unique and remarkable properties. The results of mechanical testing indicate ultrahigh tensile strength, which usually requires higher-cost materials.

Compared to other methods of preparing ultrahigh-strength steels, e.g. surface attrition with post-exfoliation from the bulk by electro-discharging and multiple stages of quenching, cold rolling, and annealing processes, low-temperature carburization—being a one-step process—is more energy efficient. The tests also indicate a significantly increased Young modulus. This means that—different from earlier interpretation—the interstitial carbon actually increases the interatomic bonding strength of the alloy (i.e., if the carbon atoms where just "spacers" between the metal atoms, they would weaken the bonding and elasticity moduli would decrease).

Along with the increased modulus, the ductility of the material decreases. The method of carburizing foils, which we have explored in this work, lends itself for striking a balance between strength and ductility by adjusting a uniform (depth-independent) carbon fraction through a combination of carburization and annealing ("boost and anneal"). This flexibility will enable the new material to function in a variety of technical applications.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof. For any stated range in this disclosure, it will be understood that a disclosed embodiment includes the midpoint of that range (regardless of whether that specific number is identified above).

Symbols & Abbreviations

As used throughout the disclosure and its figures, the following symbols will mean:

XC[z]: atom-fraction-depth profile.

Hn[z]: hardness-depth profile.

$\eta$: ratio of mean carbon depth to foil thickness.

t: specimen foil thickness.

UTS: ultimate tensile strength.

E: effective Young's modulus.

$\sigma_y$: yield strength defined as the stress at 0.2% plastic strain.

$\varepsilon_F$: strain to failure.

$\tau_0$: critical shear stress.

LTC: low-temperature carburization.

AISI-316: AISI-316 austenitic stainless steel.

SAM: scanning Auger microprobe.

SEM: scanning electron microscopy.

CSSIC: concentrated solid solution of interstitial carbon.

REFERENCES

The following references inform the foregoing disclosure:

Cao, Y., F. Ernst, and G. M. Michal, *Colossal carbon supersaturation in austenitic stainless steels carburized at low temperature*. Acta Materialia, 2003. 51(14): p. 4171-4181

Kahn, H., et al., *Interstitial hardening of duplex* 2205 *stainless steel by low temperature carburisation: enhanced mechanical and electrochemical performance*. Surface Engineering, 2012. 28(3): p. 213-219.

Michal, G. M., et al., *Paraequilibrium Carburization of Duplex and Ferritic Stainless Steels*. Metallurgical and Materials Transactions a-Physical Metallurgy and Materials Science, 2009. 40a(8): p. 1781-1790.

Sharghi-Moshtaghin, R., et al., *Low-Temperature Carburization of the Ni-base Superalloy IN*718: *Improvements in Surface Hardness and Crevice Corrosion Resistance*. Metallurgical and Materials Transactions a-Physical Metallurgy and Materials Science, 2010. 41a(8): p. 2022-2032.

Dong, Y. C., et al., *Towards near-permanent CoCrMo prosthesis surface by combining micro-texturing and low temperature plasma carburising*. Journal of the Mechanical Behavior of Biomedical Materials, 2016. 55: p. 215-227.

Collins, S. R., Williams, P. C., Marx, S. V., Heuer, A. H., Ernst, F., & Kahn, H, *Low-temperature carburization of austenitic stainless steels*. ASM handbook, 2014. 4: p. 451-460.

Williams, P. and S. Collins, *Mechanical design using low-temperature carburization*. Jom, 2008. 60(12): p. 27-30.

Agarwal, N., et al., *Enhanced fatigue resistance in* 316*L austenitic stainless steel due to low-temperature paraequilibrium carburization*. Acta Materialia, 2007. 55(16): p. 5572-5580.

Qu, J., P. J. Blau, and B. C. Jolly, *Tribological properties of stainless steels treated by colossal carbon supersaturation*. Wear, 2007. 263: p. 719-726.

O'Donnell, L. J., et al., *Wear maps for low temperature carburised* 316*L austenitic stainless steel sliding against alumina*. Surface Engineering, 2010. 26(4): p. 284-292.

Sun, Y. and E. Haruman, *Tribocorrosion behaviour of low temperature plasma carburised* 316*L stainless steel in* 0.5 *M NaCl solution*. Corrosion Science, 2011. 53(12): p. 4131-4140.

Martin, F. J., et al., *Enhanced Corrosion Resistance of Stainless Steel Carburized at Low Temperature*. Metallurgical and Materials Transactions a-Physical Metallurgy and Materials Science, 2009. 40a(8): p. 1805-1810.

Heuer, A. H., et al., *Interstitial defects in* 316*L austenitic stainless steel containing "colossal" carbon concentrations: An internal friction study*. Scripta Materialia, 2007. 56(12): p. 1067-1070.

Michal, G. M., et al., *Carbon supersaturation due to paraequilibrium carburization: Stainless steels with greatly improved mechanical properties*. Acta Materialia, 2006. 54(6): p. 1597-1606.

Nelson, J. B. and D. P. Riley, *An Experimental Investigation of Extrapolation Methods in the Derivation of Accurate Unit-Cell Dimensions of Crystals*. Proceedings of the Physical Society of London, 1945. 57(321): p. 160-177.

Nascimento, F. C., et al., *A Comparative Study of Mechanical and Tribological Properties of AISI*-304 *and AISI*-316 *Submitted to Glow Discharge Nitriding*. Materials Research-Ibero-American Journal of Materials, 2009. 12(2): p. 173-180.

Xu, W., et al., *A new ultrahigh-strength stainless steel strengthened by various coexisting nanoprecipitates*. Acta Materialia, 2010. 58(11): p. 4067-4075.

Chen, X. H., et al., *Tensile properties of a nanocrystalline* 316*L austenitic stainless steel*. Scripta Materialia, 2005. 52(10): p. 1039-1044.

Sun, G. S., et al., *Ultrahigh strength nano/ultrafine-grained* 304 *stainless steel through three-stage cold rolling and annealing treatment*. Materials Characterization, 2015. 110: p. 228-235.

Zhang, K., et al., *Ultrahigh strength-ductility steel treated by a novel quenching-partitioning-tempering process*. Materials Science and Engineering a-Structural Materials Properties Microstructure and Processing, 2014. 619: p. 205-211.

Chen, C.-w., *The structural evolution during low temperature carburization of* 17-7 *precipitation hardened stainless steel, in Department of Materials Science and Engineering*. 2012, Case Western Reserve Univeristy.

Zangiabadi, A., et al., *The Formation of Martensitic Austenite During Nitridation of Martensitic and Duplex Stainless Steels*. Metallurgical and Materials Transactions a-Physical Metallurgy and Materials Science, 2017. 48a (1): p. 8-13.

Moverare, J. J. and M. Oden, *Influence of elastic and plastic anisotropy on the flow behavior in a duplex stainless steel*.

Metallurgical and Materials Transactions a-Physical Metallurgy and Materials Science, 2002. 33(1): p. 57-71.

Haasen, P., *Physikalische Metallkunde*. 1974, Berlin; New York: Springer-Verlag. 379 p.

Labusch, R., *A Statistical Theory of Solid Solution Hardening*. Physica Status Solidi, 1970. 41(2): p. 659-&.

Busby, J. T., M. C. Hash, and G. S. Was, *The relationship between hardness and yield stress in irradiated austenitic and ferritic steels*. Journal of Nuclear Materials, 2005. 336(2-3): p. 267-278.

Gilman, J. J., *Relationship between Impact Yield Stress and Indentation Hardness*. Journal of Applied Physics, 1975. 46(4): p. 1435-1436.

Gavriljuk, V. G., *Influence of interstitial carbon, nitrogen, and hydrogen on the plasticity and brittleness of steel*. Steel in Translation, 2015. 45(10): p. 747-753.

Geraldo L. F., L. B. G., and Fernando V. N., *Damage evolution in a tensile specimen of a ductile stainless steel*. Rem: Rev. Esc. Minas, 2016. 69(2): p. 175-183.

Banerji, S. K., C. J. Mcmahon, and H. C. Feng, *Intergranular Fracture in* 4340-*Type Steels—Effects of Impurities and Hydrogen*. Metallurgical Transactions a-Physical Metallurgy and Materials Science, 1978. 9(2): p. 237-247.

What is claimed is:

1. A process of treating austenitic steel by forming a concentrated solid solution of interstitial carbon throughout the austenitic steel and without any underlying substrate layer so as to improve observed tensile strength, yield strength, and Young's modulus of the treated austenitic steel, the process comprising:

providing an original workpiece formed from austenitic steel having a defined thickness, activating a surface of the workpiece with an acid-based treatment at an elevated temperature for a selected period of time;

after the activating step, carburizing the workpiece at a temperature of less than 550° C. for a selected period of time to produce a treated workpiece; and wherein at least one of: the thickness of the workpiece, the acid based-treatment, the elevated temperature for the activating step, the selected period of time for the activating step, the elevated temperature for the carburizing step, and the selected period of time for the carburizing step are selected to ensure any underlying substrate layer is eliminated from the workpiece and wherein the treated workpiece has increased tensile strength, increased yield strength, and larger Young modulus in comparison to the austenitic steel of the original workpiece.

2. The process of claim 1 wherein the selected period of time for each of the activating and the carburizing steps are identical.

3. The process of claim 1 wherein the tensile strength of the treated workpiece is at least 3 times greater in comparison to the original workpiece.

4. The process of claim 1 wherein the yield strength of the treated workpiece is at least 4 times greater in comparison to the original workpiece.

5. The process of claim 1 wherein the Young modulus is at least 1.5 times greater in comparison to the original workpiece.

6. The process of claim 1 wherein the activating and carburizing step are repeated in succession for a first time and a second time so that the treated workpiece is formed after the second time.

7. The process of claim 6 wherein the selected periods of time for the activating and carburizing steps in the second time are reduced in comparison to the first time.

8. The process of claim 7 the selected period of time for each of the activating and the carburizing steps in the second time are identical.

9. The process of claim 1 further comprising cleaning the workpiece: (i) prior to the activation step and/or (ii) after after the carburizing step.

10. A process of producing a surgical or cutting tool, the process comprising:

providing an original workpiece formed from austenitic steel having a defined thickness, activating a surface of the workpiece with an acid-based treatment at an elevated temperature for a selected period of time;

after the activating step, carburizing the workpiece at a temperature of less than 550° C. for a selected period of time;

after the carburizing step, allowing the workpiece to cool to ambient temperature and forming a surgical or cutting tool from the workpiece; and wherein at least one of: the thickness of the workpiece, the acid based-treatment, the elevated temperature for the activating step, the selected period of time for the activating step, the elevated temperature for the carburizing step, and the selected period of time for the carburizing step are selected to ensure any underlying substrate layer is eliminated from the workpiece and wherein at least one of a tensile strength, a yield strength, and an Young modulus in the surgical or cutting tool is greater than in comparison to the original workpiece.

11. The process according to claim 10 wherein the surgical or cutting tool is a stent.

* * * * *